US005597474A

United States Patent [19]

Kerby et al.

[11] Patent Number: 5,597,474

[45] **Date of Patent: *Jan. 28, 1997**

[54] PRODUCTION OF HYDROGEN FROM A FLUID COKING PROCESS USING STEAM REFORMING

[75] Inventors: Michael C. Kerby; Roby Bearden, Jr.; Stephen M. Davis; LeRoy Clavenna, all of Baton Rouge, La.

[73] Assignee: Exxon Research & Engineering Co., Florham Park, N.J.

[ * ] Notice: The portion of the term of this patent subsequent to Jul. 25, 2012, has been disclaimed.

[21] Appl. No.: 339,109

[22] Filed: Nov. 14, 1994

Related U.S. Application Data

[63] Continuation of Ser. No. 144,986, Oct. 27, 1993, abandoned.

[51] Int. Cl.[6] ..... C10B 55/10; C10G 51/00

[52] U.S. Cl. ..... 208/50; 208/53; 208/80; 208/84

[58] Field of Search ..... 208/50, 51, 53, 208/80, 84, 120; 585/379; 502/326; 48/214

[56] References Cited

U.S. PATENT DOCUMENTS

| | | | |
|---|---|---|---|
| 3,929,431 | 12/1975 | Koh et al. | 48/214 |
| 4,269,696 | 5/1981 | Metrailer | 208/120 |
| 4,331,529 | 5/1982 | Lambert et al. | 208/8 R |
| 5,435,905 | 7/1995 | Davis et al. | 208/53 |

*Primary Examiner*—Asok Pal
*Assistant Examiner*—Bekir L. Yildirim
*Attorney, Agent, or Firm*—Henry E. Naylor

[57] ABSTRACT

The present invention relates to an integrated fluid coking/hydrogen production process. The fluid coking unit is comprised of a fluid coker reactor, a heater, and a gasifier. Solids from the fluidized beds are recycled between the coking zone and the heater and between the heater and the gasifier. A separate stream of hot solids from the gasifier is passed to the scrubbing zone of the reactor. Methane and steam are introduced into the stream of hot solids passing from the gasifier to the scrubbing zone. The hot particles act to catalyze the conversion of methane to carbon monoxide and hydrogen in the presence of steam.

5 Claims, 1 Drawing Sheet

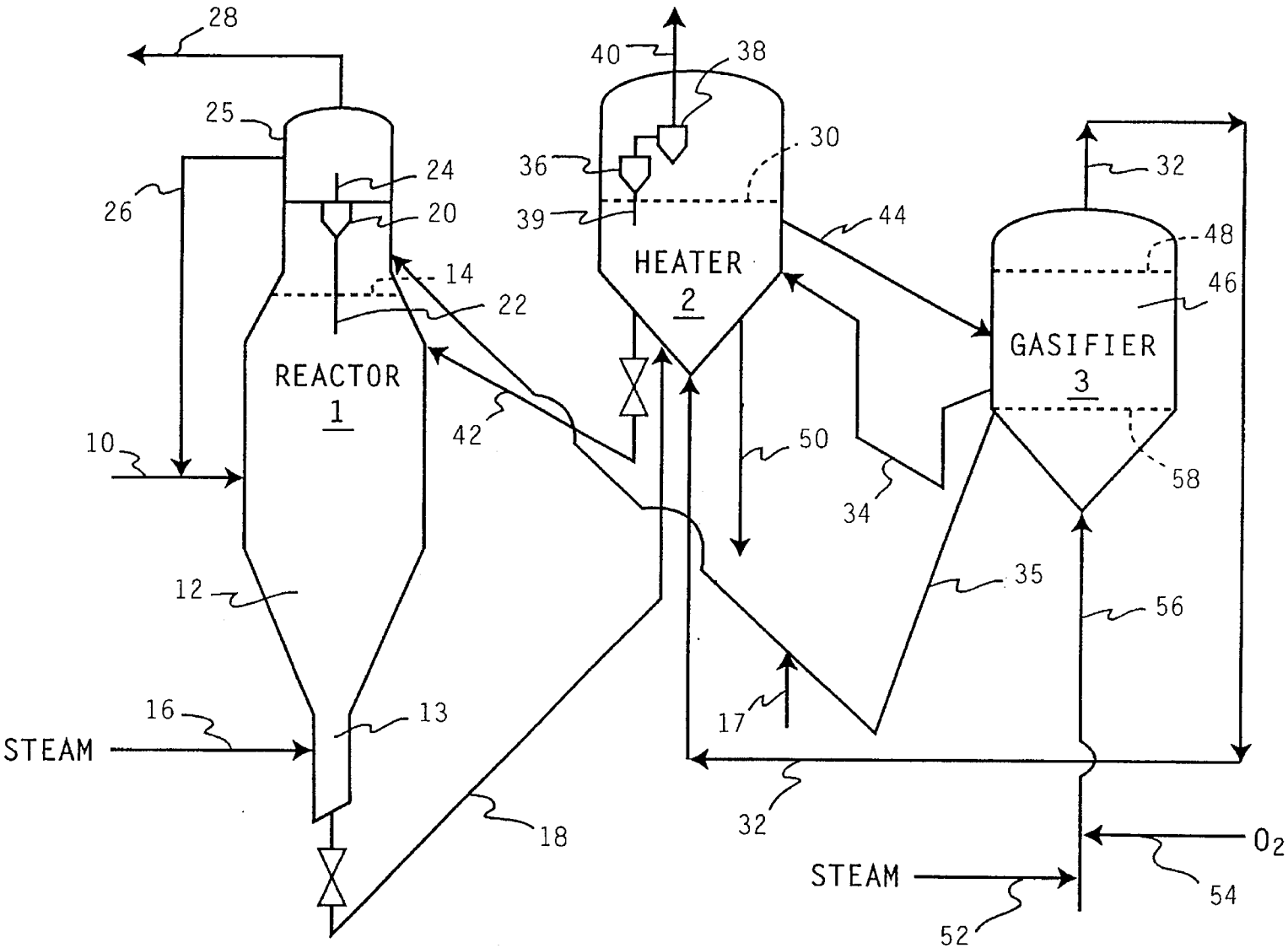
GASIFIER
3
HEATER
2
REACTOR
1
STEAM
STEAM
$O_2$
10
12
13
14
16
17
18
20
22
24
25
26
28
30
32
32
34
35
36
38
39
40
42
44
46
48
50
52
54
56
58

PRODUCTION OF HYDROGEN FROM A FLUID COKING PROCESS USING STEAM REFORMING

This is a continuation of application Ser. No. 08/144,986, filed Oct. 27, 1993, now abandoned.

FIELD OF THE INVENTION

The present invention relates to an integrated fluid coking/hydrogen production process. The fluid coking unit is comprised of a fluid coker reactor containing a scrubbing zone, a heater, and a gasifier. Solids from the fluidized beds are recycled between the coking reactor and the heater and between the heater and the gasifier. A separate stream of hot solids from the gasifier is passed to the scrubbing zone of the reactor. Methane and steam are introduced into the stream of hot solids passing to the scrubbing zone. The hot solids act to catalyze the conversion of methane to carbon monoxide and hydrogen in the presence of steam.

BACKGROUND OF THE INVENTION

Hydrogen is a very important product of any petroleum refinery. Various refinery processes, such as the hydroconversion of heavy feedstocks to lower boiling products, and hydrotreating various feedstocks to remove sulfur and/or nitrogen, consume relatively large amounts of hydrogen. While other refinery processes, such as reforming, are net producers of hydrogen, refineries as a whole are typically net users of substantial amounts of hydrogen. Separate hydrogen production facilities, or the purchase of hydrogen from outside of the refinery, i add significantly to the cost of refined products. Thus, there is a substantial need for relatively inexpensive sources of hydrogen in a petroleum refinery.

Some modern complex refineries have fluid coking units. In conventional fluid coking, a petroleum feedstock is injected into a fluidized bed of hot, fine, solids and is distributed uniformly over the surfaces of the solids where it is cracked to vapors and coke. The vapors pass through a cyclone which removes most of the entrained coke particles. The vapor is then discharged into a scrubber where substantially all of the remaining solids are removed and the products are cooled to condense the heavy liquids. The resulting slurry, which usually contains from about 1 to about 3 wt. % solids is usually recycled to extinction to the coking reactor. The solids are typically coke particles.

The coke particles in the reactor vessel flow downwardly to a stripping zone at the base of the reactor where stripping steam removes interstitial product vapors from, or between, the coke particles, as well as some adsorbed liquids from the coke particles. The coke particles then flow down a standpipe and into a riser which leads to a burner where sufficient air is injected for burning at least a portion of the coke and heating the remainder sufficiently to satisfy the heat requirements of the coking reactor where the unburned hot coke is recycled. Net coke, above that consumed in the burner, is withdrawn as product coke.

Another type of fluid coking employs three vessels: a coking reactor, a heater, and a gasifier. Coke produced in the reactor is withdrawn and is passed to the heater where a portion of the volatile matter is removed. The coke is then passed to a gasifier where it reacts, at elevated temperatures, with air and steam to form a mixture of carbon monoxide, carbon dioxide, methane, hydrogen, nitrogen, water vapor, and hydrogen sulfide. The gas produced in the gasifier is passed to the heater to provide part of the reactor heat requirement. The remainder of the heat is supplied by circulating coke between the gasifier and the heater.

There is a need in the art for producing hydrogen in more cost efficient ways, especially if a cheap source of catalyst, such as coke from a fluid coking unit can be used.

SUMMARY OF THE INVENTION

In accordance with the present invention, there is provided an integrated process for converting a heavy hydrocarbonaceous chargestock to lower boiling products and for converting methane to carbon oxides and hydrogen. The process is performed in a fluid coking process unit comprised of a fluid coking reactor containing a scrubbing zone, a heater, and a gasifier. A stream of hot solids is recycled between the coking reactor and the heater and between the heater and the gasifier. A separate stream of hot solids is passed from the gasifier to the scrubbing zone. Hydrogen and carbon monoxide are produced by introducing methane and steam directly into the stream of hot solids passing from the gasifier to the scrubbing zone. The fluid coking reactor contains a coking zone, a scrubbing zone located above the coking zone for collecting vapor phase products, and a stripping zone for stripping hydrocarbons from solid particles passing downwardly through the coking zone where they exit and are passed to the heating zone. Vapor phase products are separated in the scrubbing zone.

In a preferred embodiment of the present invention, the coking zone is operated at a temperature from about 450° C. to 650° C. and a pressure from about 0 to 150 psig.

In still another preferred embodiment of the present invention, the chargestock is selected from the group consisting of heavy and reduced petroleum crudes, petroleum atmospheric distillation bottoms, petroleum vacuum distillation bottoms, pitch, asphalt, bitumen, and liquid products derived from a coal liquefaction process.

BRIEF DESCRIPTION OF THE FIGURE

The sole FIGURE herein is a schematic flow plan of a preferred embodiment of the present invention.

DETAILED DESCRIPTION OF THE INVENTION

Suitable heavy hydrocarbonaceous feedstocks for use in the present invention include heavy hydrocarbonaceous oils, heavy and reduced petroleum crude oil; petroleum atmospheric distillation bottoms; petroleum vacuum distillation bottoms, or residuum; pitch; asphalt; bitumen; other heavy hydrocarbon residues; tar sand oil; shale oil; coal; coal slurries; liquid products derived from coal liquefaction processes, including coal liquefaction bottoms; and mixtures thereof. Such feeds will typically have a Conradson carbon content of at least 5 wt. %, generally from about 5 to 50 wt. %. As to Conradson carbon residue, see ASTM Test D189-165. Preferably, the feed is a petroleum vacuum residuum.

A typical petroleum chargestock suitable for the practice of the present invention will have the composition and properties within the ranges set forth below.

| | |
|---|---|
| Conradson Carbon | 5 to 40 wt. % |
| Sulfur | 1.5 to 8 wt. % |
| Hydrogen | 9 to 11 wt. % |
| Nitrogen | 0.2 to 2 wt. % |
| Carbon | 80 to 86 wt. % |

-continued

| | |
|---|---|
| Metals | 1 to 2000 wppm |
| Boiling Point | 340° C.+ to 650° C.+ |
| Specific Gravity | −10 to 35° API |

Reference is now made to the FIGURE, which shows a fluid coking process unit containing a coker reactor 1, a heater 2, and a gasifier 3. A heavy hydrocarbonaceous chargestock is passed via line 10 to coking zone 12 of coker reactor 1, which coking zone contains a fluidized bed of solid, or so-called "seed" particles, having an upper level indicated at 14. Although it is preferred that the solid particles be coke particles, they may also be other suitable refractory materials. Non-limiting examples of such other suitable refractory materials include those selected from the group consisting of silica, alumina, zirconia, magnesia, or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns.

A fluidizing gas e.g. steam, is admitted at the base of coker reactor 1, through line 16, into stripping zone 13 of the coker reactor in an amount sufficient to obtain superficial fluidizing velocity. Such a velocity is typically in the range of about 0.5 to 5 ft/sec. A portion of the feed forms a fresh coke layer on the fluidized solid particles. Coke at a temperature above the coking temperature, for example, at a temperature from about 40° C. to 200° C., preferably from about 65° C. to 175° C., and more preferably about 65° C. to 120° C. in excess of the actual operating temperature of the coking zone is admitted to reactor 1 by line 42 in an amount sufficient to maintain the coking temperature in the range of about 450° C. to 650° C.

The pressure in the coking zone is maintained in the range of about 0 to 150 psig, preferably in the range of about 5 to 45 psig. Conversion products are passed through cyclone 20 of the coking reactor to remove entrained solids which are returned to the coking zone through dipleg 22. The vapors leave the cyclone through line 24, and pass into a scrubber 25 at the top of the coking reactor. If desired, a stream of heavy materials condensed in the scrubber may be recycled to the coking reactor via line 26. The coker conversion products are removed from the scrubber 25 via line 28 for fractionation in a conventional manner.

In heater 2, stripped coke from coking reactor 1 cold coke) is introduced by line 18 to a fluid bed of hot coke having an upper level indicated at 30. The bed is partially heated by passing a fuel gas into the heater by line 32. Supplementary heat is supplied to the heater by coke circulating from gasifier 3 through line 34. The gaseous effluent of the heater, including entrained solids, passes through a cyclone which may be a first cyclone 36 and a second cyclone 38 wherein the separation of the larger entrained solids occur. The separated larger solids are returned to the heater bed via the respective cyclone diplegs 39. The heated gaseous effluent which contains entrained solids is removed from heater 2 via line 40.

As previously mentioned, hot coke is removed from the fluidized bed in heater 2 and recycled to coking reactor by line 42 to supply heat thereto. Another portion of coke is removed from heater 2 and passed via line 44 to a gasification zone 46 in gasifier 3 in which is also maintained a bed of fluidized solids to a level indicated at 48. If desired, a purged stream of coke may be removed from heater 2 by line 50.

The gasification zone is maintained at a temperature ranging from about 870° C. to 1100° C. at a pressure ranging from about 0 to 150 psig, preferably at a pressure ranging from about 25 to about 45 psig. Steam via line 52, and an oxygen-containing gas, such as air, commercial oxygen, or air enriched with oxygen via line 54, and passed via line 56 into gasifier 3. The reaction of the coke particles in the gasification zone with the steam and the oxygen-containing gas produces a hydrogen and carbon monoxide-containing fuel gas. The gasified product gas, which may contain some entrained solids, is removed overhead from gasifier 3 by line 32 and introduced into heater 2 to provide a portion of the required heat as previously described.

A separate stream of hot solids is passed from the gasifier 3 to scrubbing zone 25 via line 35. Methane and steam are introduced into the stream of hot solids in line 35 via line 17 where it is converted to carbon oxide and hydrogen. It will be understood that the methane and steam may be introduced separately into line 35 instead of as a mixture. The hydrogen and carbon monoxide which are produced are collected overhead with other gases via line 28 and sent to a separation unit where various components are separated.

It is within the scope of the present invention to improve conversion activity by introducing an effective amount of one or more metals selected from Groups I, such as Na and K Group IIA, such as Mg and Ca; Group VA, such as V; Group VIA, such as Cr and Mo; Group VIIA, such as Mn, and Group VIIIA, such as Fe, Co, and Ni. The groups referred to are from the Periodic Table of the Elements as published by Sargent-Welch Scientific Co., Catalog Number S-18806, 1979. Preferred are K, Ca, V, Ni, and Fe. Effective amount, as used herein, means that amount which will cause an measureable increase in conversion activity, preferably at least a 5% increase in activity, more preferably at least a 10% in activity, over the case where no such metal are added. Compounds or mixtures of compounds containing said metals can be added with the feed to the fluid coker reactor, or may be introduced as a separate stream into any of the vessels of the coking process unit.

Having thus described the present invention, and a preferred embodiment thereof, it is believed that the same will become even more apparent by reference to the following examples. It will be appreciated, however, that the examples, as well as the FIGURE hereof, are presented for illustrated purposes and should not be construed as limiting the invention.

EXAMPLES

Samples of gasifier cokes, Coke A (91.74 wt. % C; 0.03 wt. % H; 1.13 wt. % V; 0.48 wt. % Ni; 0.19 wt. % Fe; Surface Area 168 $m_2/g$) and Coke B (86.98 wt. % C; 0.14 wt. % H; 0.25 wt. % V; 0.14 wt. % Ni; 0.04 wt. % Fe; Surface Area 162 $m^2/g$) obtained from a fluid coker process unit containing a coker reactor, a heater, and a gasifier were placed in a ½" Inconel tubular fixed bed reactor modified with a high purity $\alpha$-$Al_2O_3$ liner to avoid reactions on the reactor metal wall. A thermal reference using high purity $\alpha$-$Al_2O_3$ is included for comparison.

Table 1 shows the steam reforming activity of a 1:2 mixture of $CH_4$ and $H_2O$ using the gasifier cokes, Coke A and Coke B. The $CH_4$ conversion was 41.9%, 25.4% and 5.5% for the BT-Bed, RT-Bed, and thermal reference, respectively

TABLE 1

Methane Steam Reforming with Gasifier Cokes

| Run Number<br>Catalyst | MSG3-182<br>Coke A | MSG3-183<br>Coke B | MSG3-181B<br>Thermal Ref. |
|---|---|---|---|
| Weight (g) | 3.876 | 3.876 | |
| Volume (cc) | 4.56 | 4.56 | 4.56 |
| Hrs on Balance | 4.48 | 4.83 | 1.30 |
| Residence Time (sec) | 1.19 | 1.29 | 0.90 |
| Temperature (°F.) | 1700 | 1700 | 1700 |
| Pressure (psia) | 30.4 | 30.5 | 19.1 |
| Feed (mol %) | | | |
| $H_2$ | 0.0 | 0.0 | 0.0 |
| CO | 0.0 | 0.0 | 0.0 |
| $CH_4$ | 35.88 | 35.86 | 35.89 |
| $H_2O$ | 64.12 | 64.14 | 64.11 |
| Product (mol %) | | | |
| $H_2$ | 45.79 | 31.79 | 6.88 |
| CO | 12.88 | 4.79 | 0.95 |
| $CO_2$ | 4.98 | 4.58 | 0.54 |
| $CH_4$ | 14.47 | 21.30 | 32.83 |
| $H_2O$ | 21.87 | 37.54 | 58.81 |
| $CH_4$ Conversion (%) | 41.91 | 25.42 | 5.51 |

Table 2 shows the steam reforming activity of a gas mixture containing $CH_4$, CO, $H_2$, and $H_2O$ in ca. a 1:1:1:2 ratio, respectively, using the Coke A and Coke B gasifier cokes. The $CH_4$ conversion was 41.3%, 22.5% and 4.3% for the Coke A, coke B, and the thermal reference, respectively.

TABLE 2

Methane Steam Reforming with Gasifier Cokes

| Run Number<br>Catalyst | MSG3-179<br>Coke A | MSG3-180<br>Coke B | MSG3-181<br>Thermal Ref. |
|---|---|---|---|
| Weight (g) | 2.584 | 2.584 | |
| Volume (cc) | 3.04 | 3.04 | 3.04 |
| Hrs on Balance | 5.25 | 5.82 | 4.00 |
| Residence Time (sec) | 0.64 | 0.62 | 0.55 |
| Temperature (°F.) | 1700 | 1700 | 1700 |
| Pressure (psia) | 24.0 | 21.8 | 19.1 |
| Feed (mol %) | | | |
| $H_2$ | 20.05 | 20.11 | 20.11 |
| CO | 20.20 | 20.27 | 20.27 |
| $CH_4$ | 20.09 | 20.16 | 20.16 |
| $H_2O$ | 39.66 | 39.45 | 39.47 |
| Product (mol %) | | | |
| $H_2$ | 44.41 | 35.69 | 27.21 |
| CO | 20.10 | 13.70 | 13.42 |
| $CO_2$ | 7.35 | 8.63 | 6.86 |
| $CH_4$ | 10.20 | 14.90 | 19.03 |
| $H_2O$ | 17.95 | 27.09 | 33.48 |
| $CH_4$ Conversion (%) | 41.31 | 22.50 | 4.31 |

What is claimed is:

1. An integrated process for convening a heavy hydrocarbonaceous chargestock to lower boiling products and for producing hydrogen, said process being performed in a fluid coking process unit comprised of a fluid coking reactor, a heater, and a gasifier, said fluid coking reactor containing a coking zone, a scrubbing zone located above the coking zone for collecting vapor phase products, and a stripping zone for stripping hydrocarbons from solid particles passing downwardly through the coking zone, which process comprises:

(a) introducing the heavy hydrocarbonaceous chargestock having a Conradson carbon content of at least about 5 wt. %, to the coking zone containing a fluidized bed of solid particles and maintained at temperatures from about 450° and 650° C. and pressures from about 0 to 150 psig, wherein it is convened to lower boiling products which includes a vapor phase product, including normally liquid hydrocarbons, and where coke is deposited on the solid particles;

(b) passing the vapor phase product to said scrubbing zone wherein entrained solid particles are removed and conversion products are collected overhead;

(c) passing a portion of the solid particles which remained in the coking zone with coke deposited thereon downwardly through the coking zone, past the stripping zone, thereby stripping hydrocarbons from said solid particles, where it exits and is passed to the heating zone which contains a fluidized bed of solid particles and operated at a temperature from about 40° to 200° C. greater than that of the coking zone;

(d) recycling at least a portion of the heated solid particles from the heating zone to said coking zone;

(e) passing a portion of heated solid particles from the heater to the gasifier, said gasifier being operated at a temperature from about 870° to 1100° C., thereby further heating said solid particles;

(f) recycling a portion of further heated solid particles from the gasifier to the heater;

(g) passing another portion of further heated solid particles from the gasifier to the scrubbing zone;

(h) introducing methane and steam into the stream of solids passing from said gasifier to said scrubbing zone, thereby producing carbon oxides and hydrogen;

(i) collecting a gaseous stream from said scrubbing zone, which gaseous stream includes carbon oxides and hydrogen; and (j) separating and collecting hydrogen from the gaseous stream of (i) above.

2. The process of claim 1 wherein the chargestock is selected from the group consisting of heavy and reduced petroleum crudes, petroleum atmospheric distillation bottoms, petroleum vacuum distillation bottoms, pitch, asphalt, bitumen, and liquid products derived from a coal liquefaction process.

3. The process of claim 2 wherein the chargestock has a Conradson carbon content of about 5 to 40 wt. %.

4. The process of claim 1 wherein an effective amount of metal selected from Group IA, IIA, VA, VIA, VIIA, and VIIIA of the Periodic Table of the Elements is used by introducing said metal at any stage of said integrated process.

5. The process of claim 4 wherein the metal is selected from the group consisting of potassium, calcium, vanadium, nickel, and iron.

* * * * *